US005474419A

United States Patent [19]

Reluzco et al.

[11] Patent Number: 5,474,419

[45] Date of Patent: Dec. 12, 1995

[54] FLOWPATH ASSEMBLY FOR A TURBINE DIAPHRAGM AND METHODS OF MANUFACTURE

[76] Inventors: George Reluzco, 3560 E. Lydius St., Schnectady, N.Y. 12303; Alexander Morson, 47 Wheeler Dr., Clifton Park, N.Y. 12065; Thomas P. Russo, 2569 Old Mill Rd., Galway, N.Y. 12074

[21] Appl. No.: 204,566

[22] Filed: Mar. 1, 1994

Related U.S. Application Data

[63] Continuation-in-part of Ser. No. 996,933, Dec. 30, 1992.

[51] Int. Cl.[6] ..... F01D 1/02

[52] U.S. Cl. ..... 415/209.4; 415/210.1

[58] Field of Search ..... 415/189, 191, 415/209.4, 209.3, 210.1; 416/189, 191

[56] References Cited

U.S. PATENT DOCUMENTS

| | | | |
|---|---|---|---|
| 1,938,382 | 12/1933 | Haigh . | |
| 2,079,473 | 5/1937 | Wade . | |
| 2,110,679 | 3/1938 | Robinson . | |
| 2,681,788 | 6/1954 | Wosika | 253/78 |
| 2,914,300 | 11/1959 | Sayre | 253/78 |
| 3,738,307 | 6/1973 | Jacobsen et al. . | |
| 3,836,282 | 9/1974 | Mandelbaum et al. . | |
| 3,909,157 | 9/1975 | Wachtell et al. . | |
| 4,195,396 | 4/1980 | Blazek | 415/208.1 |
| 4,288,677 | 9/1981 | Sakata et al. . | |
| 4,464,094 | 8/1984 | Gerken | 415/217 |
| 4,509,238 | 4/1985 | Lee et al. . | |
| 4,643,636 | 2/1987 | Libertini et al. . | |
| 4,728,258 | 3/1988 | Blazek et al. . | |
| 4,940,386 | 7/1990 | Feuvrier et al. | 415/189 |
| 5,017,091 | 5/1991 | Tran . | |
| 5,174,715 | 12/1992 | Martin | 415/210.1 |
| 5,272,869 | 12/1993 | Dawson et al. | 425/209.4 |
| 5,332,360 | 7/1994 | Correia et al. | 415/209.3 |

*Primary Examiner*—Edward K. Look
*Assistant Examiner*—Mark Sgantzos

[57] ABSTRACT

The flowpath assembly includes inner and outer circular bands 16 and 18, respectively, and a plurality of stator blades 20 extending between the bands. The tip portions 26 of the stator blades and the openings 30 in the outer bands are at least as large as the footprints F of the blades in a radial direction. Thus, the airfoil portions 22 of the blades, which are bowed, tapered and twisted, are receivable through the openings 30 in the outer band 18 during assembly. The tip and root portions 24 and 26, respectively, of the blades are secured in the openings by welding.

16 Claims, 7 Drawing Sheets

FLOWPATH ASSEMBLY FOR A TURBINE DIAPHRAGM AND METHODS OF MANUFACTURE

RELATED APPLICATIONS

This is a continuation-in-part of application Ser. No. 07/996,933, filed Dec. 30, 1992.

TECHNICAL FIELD

The present invention relates to a flowpath assembly for the diaphragm of a turbine using stator blades of complex bowed and twisted geometry and methods of fabrication of the flowpath assembly.

BACKGROUND

The diaphragms of turbines conventionally employ a flowpath assembly comprised of inner and outer spacer bands between which are affixed generally radially extending stator blades defining a nozzle stage for the turbine. The stator blades conventionally are aerodynamically shaped, for example, to receive steam in a steam turbine, and turn the steam in the desired direction for acceleration and impingement on turbine buckets. Typically, a stator blade has an airfoil section extending between the inner and outer spacer bands and which airfoil increases in cross-sectional area in a radially outward direction. The manufacture and assembly of the nozzle stage typically includes locating inner and outer arcuate bands on a jig assembly and inserting the stator blades through circumferentially spaced openings in the outer band until the root portion of the stator blade is received within a correspondingly shaped opening in the inner band. The openings in the inner and outer bands are generally complementary in shape to the airfoil cross-section of the stator blade adjacent the root and tip portions, respectively. After insertion, the blades are then secured to the inner and outer bands, typically by welding. This process is described and illustrated in U.S. Pat. No. 4,509,238, of common assignee herewith.

Advanced vortex airfoil shapes for stator blades havemore recently been developed. These stator blades have bowed and twisted geometries which prevent assembly of the stator blades in the manner described previously and set forth in U.S. Pat. No. 4,509,238. Particularly, the bowed and twisted geometry of these new advanced vortex stator blades prevent the blades from being inserted through the openings in the outer band because the blade cross-section at one or more locations along its length cannot pass through the outer opening which is shaped complementary to the cross-sectional shape of the blade tip. That is, the bowed and twisted geometry of the advanced vortex blade interferes with the margin of the outer opening upon attempted insertion of the blade through the opening and prevents its full insertion.

As used herein, the phrases "generally radially" or "generally radial direction" are not intended to mean solely coincident with a true radius but embrace within their meaning blades or directions slightly angled relative to a true radius as well as blades and directions lying along the true radius. For example, stator blades per se or elements thereof, e.g., their trailing edges, may be inclined in axial or tangential directions or both. Further blade insertion directions through and into the bands may be slightly angled axially or tangentially or both relative to a true radius.

DISCLOSURE OF THE INVENTION

According to the present invention, there is provided an improved flow path assembly and methods of manufacturing wherein the advanced vortex stator blades can be inserted through the openings in the outer band for final securement to the inner and outer bands, notwithstanding the bowed and twisted geometry of the blades which would otherwise preclude such insertion through outer band openings complementary in shape to the tips of the blades. To accomplish the foregoing, the footprint of the stator blade in a generally radial direction is ascertained. The footprint, for advanced vortex stator blades, is generally larger than the largest cross-section of the blade throughout the radial extent of its airfoil portion. The openings in the outer band are formed having a cross-section at least as large as the footprint such that the blades are receivable, preferably with a clearance, through the outer openings upon their insertion in a generally radial direction. Additionally, the tip portions of the blades are provided with a cross-sectional configuration at least as large as the footprint. This tip cross-sectional configuration corresponds substantially in cross-section to the cross-section of the openings through the outer band. In this manner, the advanced vortex blades can be inserted, root portions first, through the openings in the outer band, with the assurance that the airfoil portions of the blades will pass through the outer band openings with a clearance. Preferably, each root portion has a cross-section generally complementary to the cross-section of the corresponding opening in the inner band. The footprint of the root portion of the blade is preferably equal to the smallest cross-section of the blade airfoil. Thus, the transition from the airfoil to the root portion provides a position locating feature which positions the blade in the correct radial location relative to the inner and outer bands. This self-locating feature is provided by using parallel surfaces on the root as well as complementary parallel surfaces on the inner ring opening, thus making the transition. Consequently, when the stator blades are fully inserted, each root portion is received in the complementary shaped opening in the inner band with the transition forming a radial stop. The enlarged tip portion of the blade is thus received and located in the complementary shaped opening in the outer band. The stator blades are then secured to the inner and outer bands, for example, by welding along the entirety of the root and tip portions and along only the outer diameter of the outer band and the inner diameter of the inner band. This precludes disturbance of the gas flow over the airfoil by the welds.

Both root and tip portions of the stator blades are preferably formed with parallel, generally radially extending wall surfaces. The wall surfaces of the inner and outer bands defining the openings therethrough are similarly preferably generally parallel to one another in a generally radial direction. While the root and tip portions of the blades are generally airfoil in shape, they need not be and can be of different shapes, for example, oval, circular or rectangular.

In a preferred embodiment according to the present invention, there is provided a flowpath assembly for the diaphragm of a turbine, comprising circumferentially extending inner and outer bands spaced radially from one another, each of the bands having a plurality of circumferentially spaced openings extending through the bands between inner and outer surfaces thereof, a plurality of stator blades extending generally radially between the bands, each blade having root and tip portions for reception in the openings of the inner and outer bands, respectively, and a twisted and bowed airfoil portion extending between the root and tip portions.

Each blade has a generally airfoil-shaped footprint in the generally radial direction within which all surface areas of the airfoil portion projected in that direction onto a tangential plane normal to the generally radial direction lie either within or coincident with peripheral confines of the footprint and the openings in the outer band have a generally airfoil-shaped cross-section at least as large as the footprint and generally complementary in shape relative to the footprint such that the blades are receivable through the outer openings with clearance, at least the tip portions of the blades having cross-sectional configurations at least as large as the footprint and substantially corresponding in cross-section to the cross-section of the openings though the outer band, the blades and inner and outer bands being welded to one another.

In a further preferred embodiment according to the present invention, there is provided a method of manufacturing a turbine steam path assembly comprising the steps of providing arcuate inner and outer bands of different diameters, providing a plurality of stator blades each having root and tip portions, an airfoil portion between the root and tip portions and a footprint in a radial direction within which all surface areas of the airfoil portion projected in that direction onto a tangential plane normal to the generally radial direction lie either within or coincident with peripheral confines of the footprint, forming a plurality of circumferentially spaced openings through the inner band between inner and outer surfaces thereof for receiving the root portions of the blades, forming a plurality of circumferentially spaced openings through the outer band between inner and outer surfaces thereof of a cross-section at least as large as the footprint such that the blades are receivable through the outer openings, forming the tip portions of the blades with cross-sectional configurations at least as large as the footprint and generally complementary in cross-sectional shape thereto, arranging the inner and outer bands generally concentrically relative to one another, inserting the blades in a radially inward direction through the openings in the outer band to locate the root portions in the openings in the inner band and the tip portions in the openings in the outer band, providing stops at transitions between the root portions and the airfoil portions, engaging the stops against the inner band to preclude further radially inward inserting movement and welding the blades to the inner and outer bands.

Accordingly, it is a primary object of the present invention to provide a novel and improved flowpath assembly for advanced vortex stator blades having bowed and twisted geometries and methods of manufacturing the flowpath assembly.

BEST MODE FOR CARRYING OUT THE INVENTION

Figure 1:
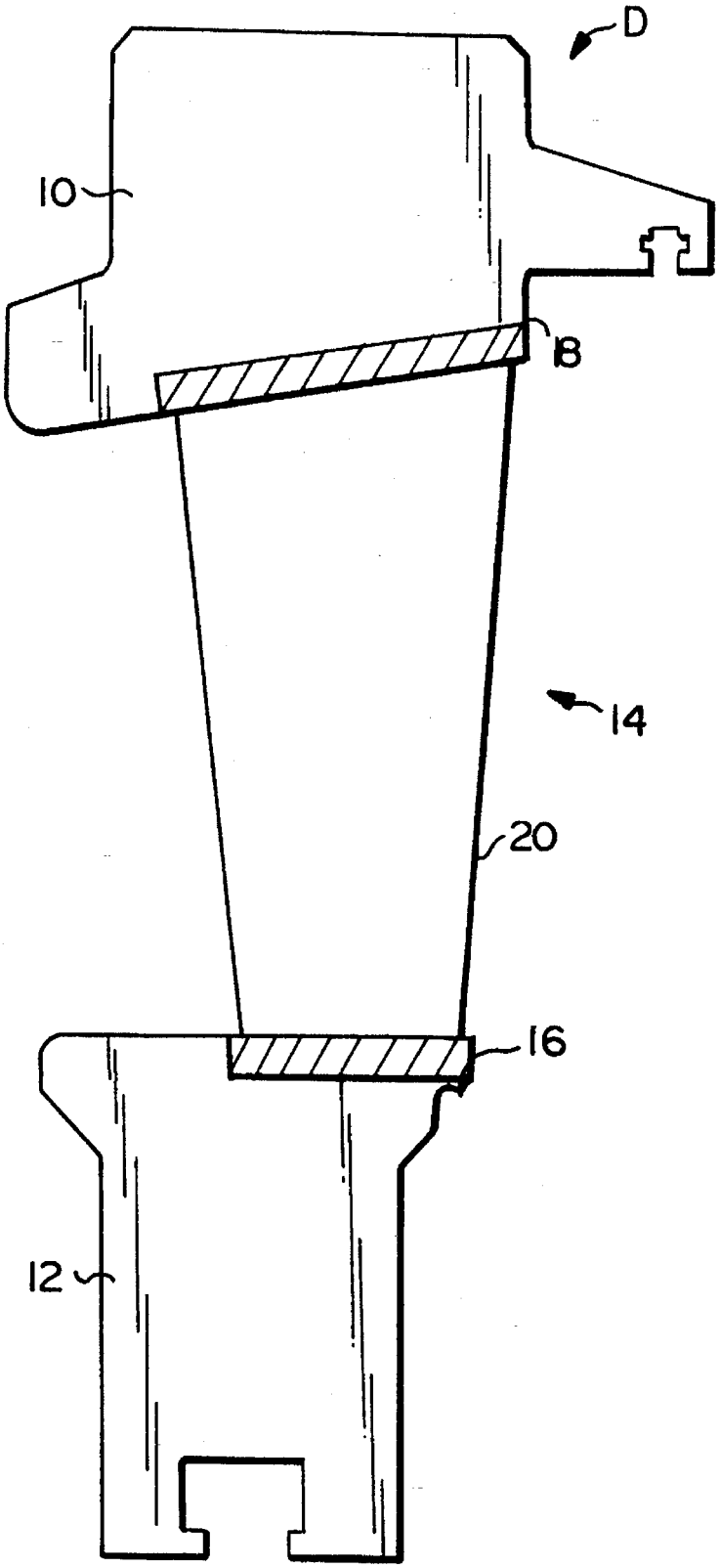
FIG. 1 is a cross-sectional view through a turbine diaphragm along a plane parallel to and containing the axis of rotation of the turbine and illustrating a flowpath assembly according to the present invention.

Referring now to FIG. 1, there is illustrated the main components of a turbine diaphragm, generally designated D. Particularly, diaphragm D includes an outer ring 10 and an inner web 12 between which is located a flowpath assembly, generally designated 14. Flowpath assembly 14 includes a plurality of circumferentially spaced nozzles defined by inner and outer spacer bands 16 and 18, respectively, and a plurality of circumferentially spaced stator blades 20 extending between the inner and outer bands 16 and 18. These stator blades are thus circumferentially spaced one from the other with each adjacent pair defining, with the inner and outer spacer bands, nozzles for the flowpath assembly. The bands 16 and 18 have different diameters and may also have different angles in relation to the axis of the turbine.

Figure 2:
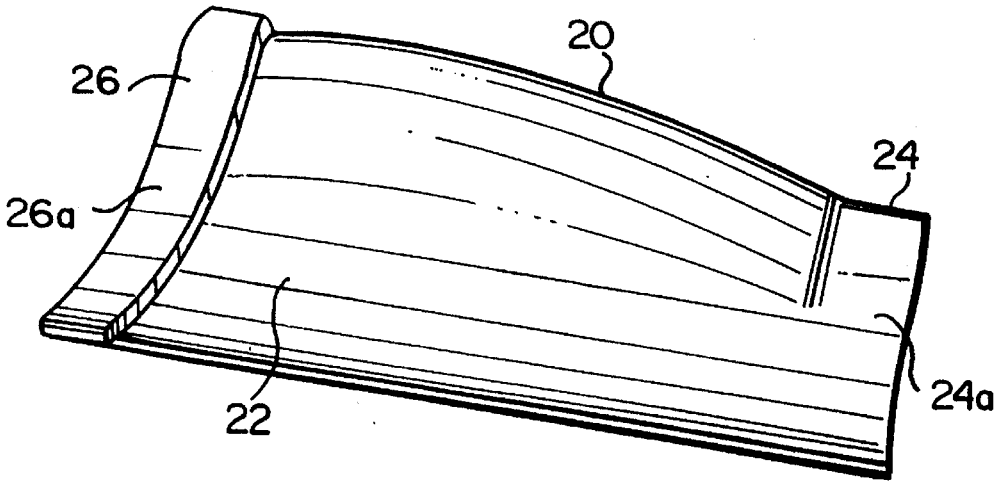
FIG. 2 is a perspective view of a single stator blade constructed in accordance with the present invention.
Figure 3:
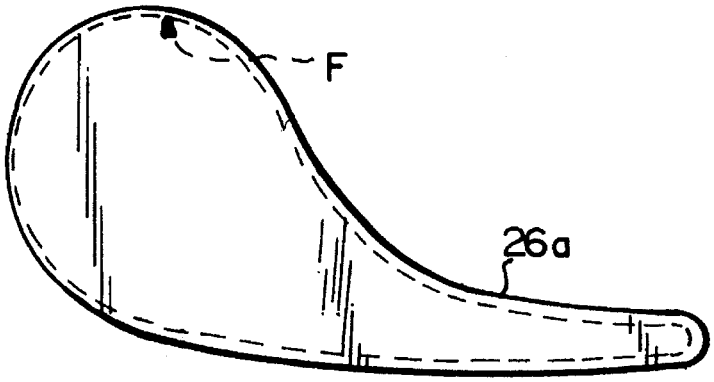
FIG. 3 is an end view of the blade of FIG. 2 looking from left to right in FIG. 2 with the dashed lines indicating the footprint of the blade.

Referring now to FIGS. 2 and 3, it will be seen that each stator blade 20 comprises an airfoil portion 22 between root and tip portions 24 and 26, respectively. It will also be seen that the airfoil surfaces of the advanced vortex blade 20 are bowed, tapered and/or twisted. That is, the various cross-sections along the length of the airfoil portion 22 of the blade 20 are different from one another and have lateral confines which extend either inside or outside of the lateral confines of other cross-sections. For example, a cross-section taken about one-third the distance from the tip portion 26 along airfoil portion 22 does not lie wholly within the cross-section of the airfoil portion 22 directly adjacent the tip portion 26, as illustrated. The cross-section at that one-third point may also have surfaces lying outside or inside, or both, of the lateral confines of the cross-section adjacent the tip portion of the root. Consequently, the bowed, tapered and twisted geometry of the airfoil portion of advance vortex blades defines a footprint in a generally radial direction within which all surface areas projected in that direction onto a tangential plane normal to the generally radial direction lie either within or coincident with the peripheral confines of the footprint. The footprint for the blade illustrated in FIG. 2 is illustrated by the dashed-line configuration F in FIG. 3. Thus, all cross-sections of the airfoil portion 22 of stator blade 20 lie within or coincident with the dashed-line configuration or footprint F illustrated in FIG. 3. Consequently, the blade cannot be received in an opening corresponding in cross-sectional configuration to the cross-section of many of the airfoil sections along the blade.

In accordance with the present invention, the tip portion 26 of the stator blade is enlarged from the cross-section of the airfoil shape directly adjacent the tip portion into a peripheral outline coincident with or larger than the footprint F. This enables the bowed, twisted blade to be inserted radially inwardly through the outer band toward final seating of the root portion in the inner band. As will be seen from the ensuing description, the shape of the opening through the outer band is generally and preferably complementary to the cross-sectional shape of the tip portion 26.

The stator blade 20 is located in final assembly in the radial direction by the root portion shown as 24 in FIG. 2. The footprint 24 of the root portion is equal to the smallest cross-section of the airfoil 22. The transition from the airfoil 22 to the root portion 24 provides a positive locating or radial stop which positions the blade 20 in the correct radial location relative to the inner and outer bands 16 and 18. Thus, the transition includes an airfoil portion which projects laterally beyond the peripheral confines of the corresponding opening in the inner band receiving the root portion and which projecting airfoil portion engages the inner band to preclude further radial inward movement of the blade. This self-locating feature is accomplished while using parallel surfaces on the root and tip portion 24 and 26 as well as the inner and outer band openings 28 and 30. That is, from a review of FIG. 2, it will be seen that the margins or walls 24*a* and 26*a* forming the root and tip portions 24 and 26, respectively, lie generally parallel one to the other in a generally radial direction. As will be seen, the root and tip portions are received in the openings in the inner and outer bands which have conformal or complementary shaped parallel wall surfaces. The bowed or twisted geometry of the airfoil is thus used to locate the blade relative to the bands.

Figure 4:
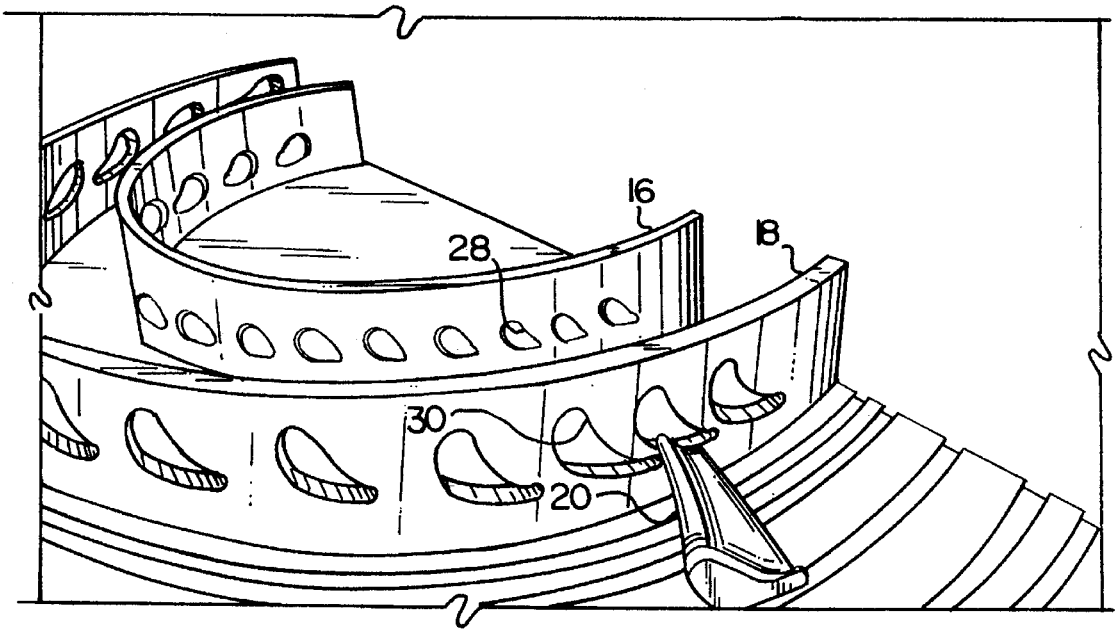
FIGS. 4, 5 and 6 illustrate various steps in the manufacture and assembly of the flowpath assembly according to the present invention.
Figure 5:
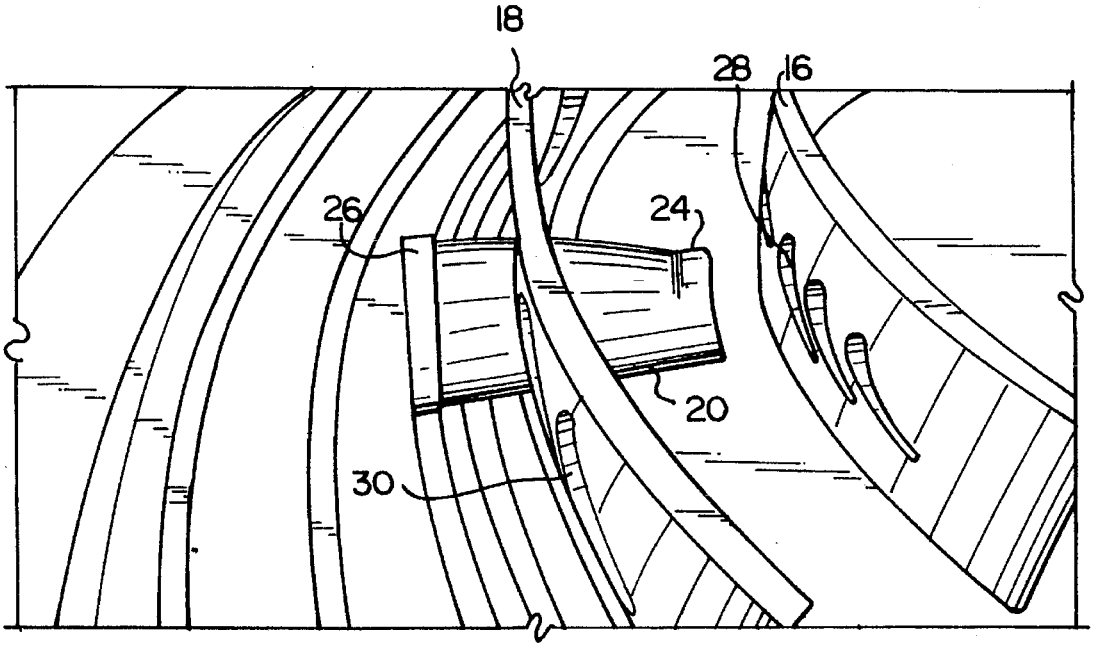
Figure 6:
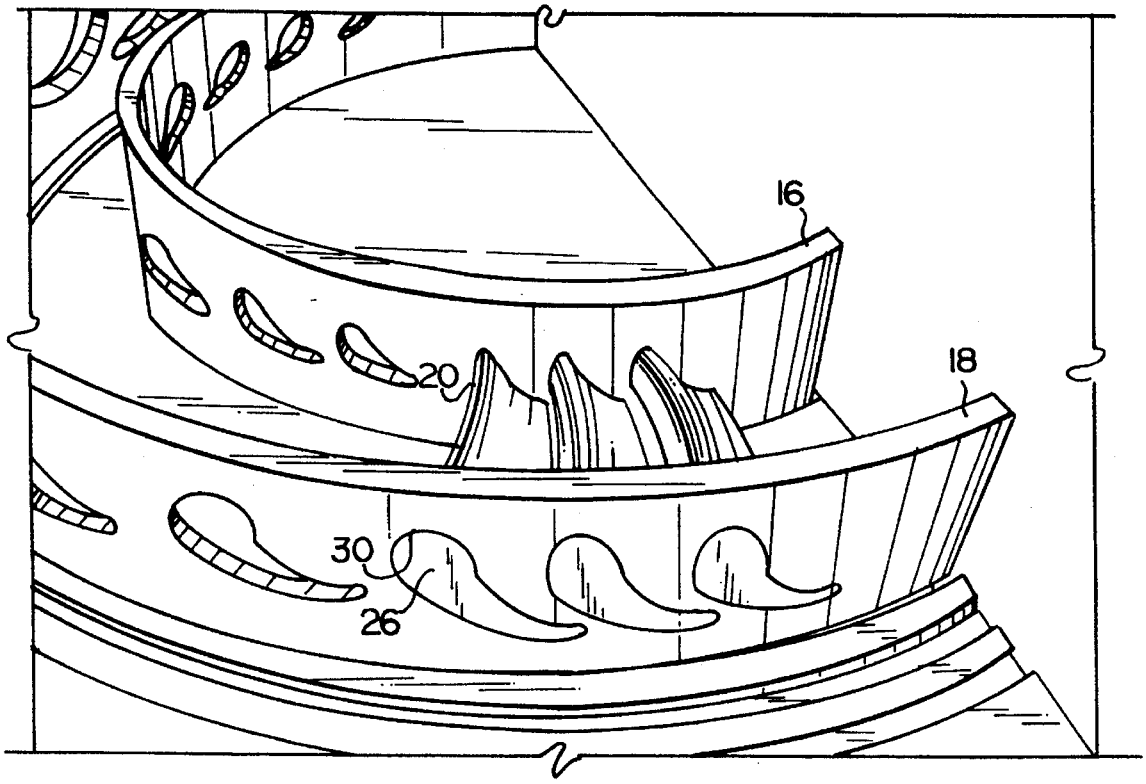

Referring now to FIGS. 4, 5 and 6 illustrating the assembly of the flowpath, the inner and outer bands 16 and 18, respectively, are located on a jig table and are generally semi-circular in configuration. It will be appreciated that complete circular inner bands can be used to assemble the flowpath assembly, although preferably semi-circular sections are used by rolling alloy steel plate into a 180° arc. The band openings 28 and 30 may be formed by a punching or laser cutting process. It will also be appreciated that the outer band 18 is angled from one edge to the other. Consequently, the wall portions and defining the inner and outer openings 28 and 30, respectively, formed in the inner and outer bands 16 and 18 lie preferably parallel to one another and generally parallel to the radius between the inner and outer bands. (There will be a slight angle formed between a radius passing through the wall portions and the flat wall surfaces of those openings).

In accordance with the present invention, the outer openings 30 are formed of a size and configuration at least as large as the footprint F of the airfoil portions of blades 20. While the openings 30 are illustrated in an airfoil configuration, they need not be airfoil in shape and may comprise other shapes, for example, oval, rectangular or otherwise, subject only to being of a size to permit a blade airfoil having a footprint F to pass through the opening. The tip portions 26, however, are preferably complementary in shape to the shape of the openings 30. By forming the openings 30 at least as large as the footprint F, the entire length of the blade may be inserted through the opening 30 in a direction toward the inner band 16, preferably with a clearance between the blade 20 and the opening 30.

Figure 7:
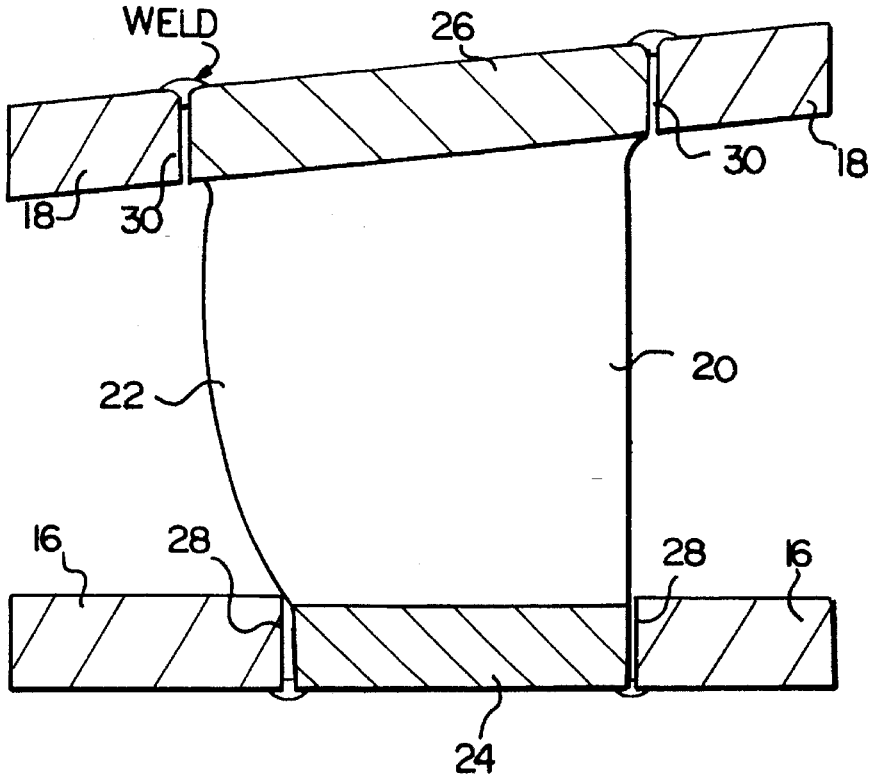
FIG. 7 is a cross-sectional view through the inner and outer bands illustrating the welded connection between the bands and the blade.
Figure 7:
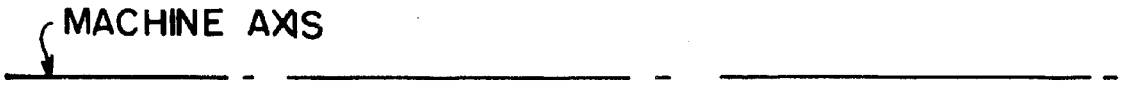
Figure 8:
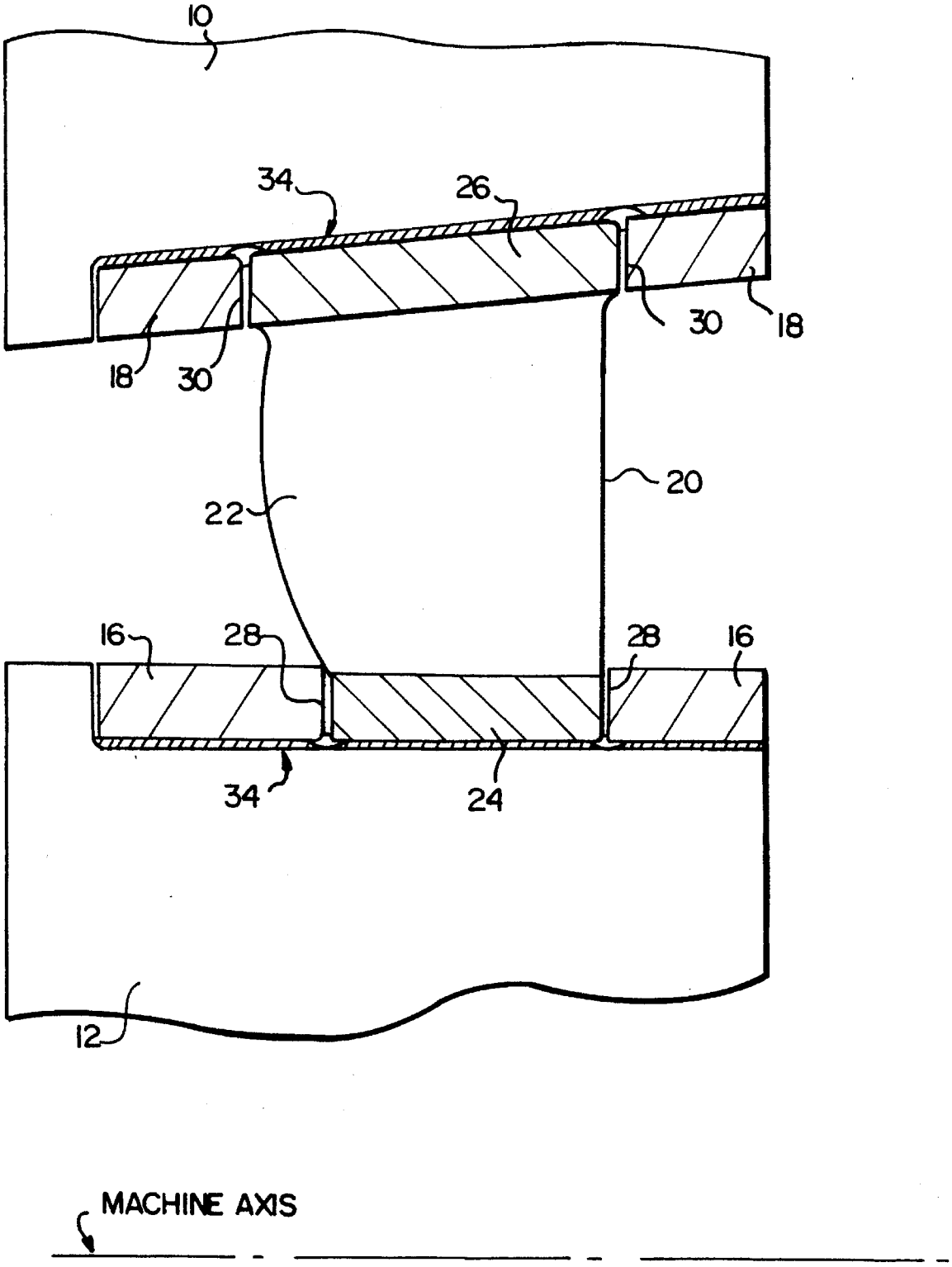
FIG. 8 is a view similar to FIG. 7 illustrating the welded connection of the bands and the steam path sub-assembly; and FIGS. *9a–9e* are schematic illustrations of various arrangements of the inner and outer bands and the blades.
Figure 9A:
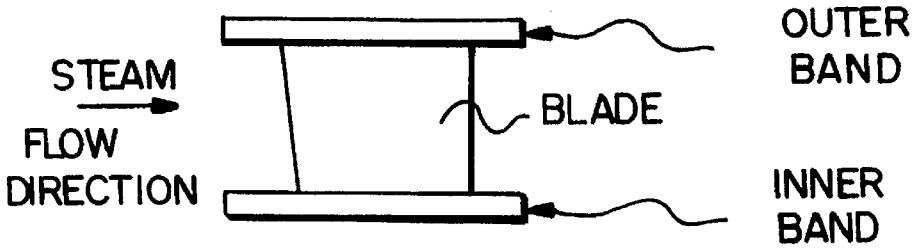
Figure 9B:
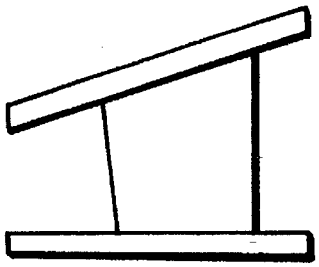
Figure 9C:
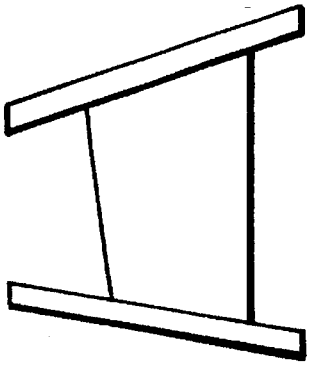
Figure 9D:
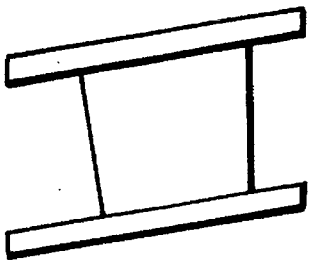
Figure 9E:
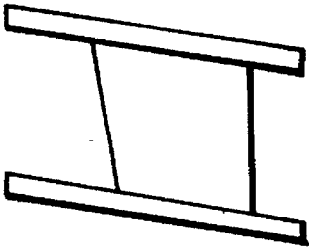

Upon full insertion of the blades 20 through openings 30, it will be appreciated that the root portions 24 engage within the openings 28 in the inner band 16 in generally complementary fashion therewith, while the tip portions 26 engage in the openings 30 of the outer band, likewise in complementary fashion therewith. The transition between the root portion and the airfoil provides a stop for radially locating the blade in assembly. Consequently, only the airfoil portions 22 extend between the inner and outer bands and, hence, into the flowpath of the turbine. The blades are preferably secured to both inner and outer bands by welding as shown in FIG. 7. The weld extends over the entire perimeter of the footprint of the root and tip portions of the blades. The welded blades and bands thus form a steam path subassembly. Note that the welds are located on the outer diameter of the outer band and the inner diameter of the inner band. The subassembly welds are thereby located outside the gas path so as not to disturb the gas flow over the airfoil. Welds in the gas path would otherwise degrade the efficiency of the airfoil. Note that in order to keep welds out of the gas path, the openings in the inner and outer bands must extend entirely through the band. The steam path subassembly is subsequently welded to the semi-circular halves of the outer ring 10 and inner web 12 as shown in FIG. 8. Again, the welds are outside of the gas path. An electron beam (EB) welding process is used to perform this weld. The EB weld depth is such that the entire axial length of the bands are welded. The EB weld extends 180° on each diaphragm half. It should be noted that the inner and outer bands may or may not be radially inclined. FIG. 9 shows several possible steam path subassembly configurations. While most diaphragms will be configured as shown in FIGS. 9*a* and 9*b*, other diaphragms may be configured as shown in FIGS. 9*c* through 9*e*.

It will also be appreciated from a review of FIG. 2 that there is a very small radius forming the transition between the tip portion 26 and the airfoil portion 22. This minimizes the intrusion of the blade into the flowpath.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A flowpath assembly for the diaphragm of a turbine, comprising:

circumferentially extending inner and outer bands spaced radially from one another, each of said bands having a plurality of circumferentially spaced openings extending through the bands between inner and outer surfaces thereof, the openings in said inner band being smaller than the openings in the outer band;

a plurality of stator blades extending generally radially between said bands, each blade having root and tip portions for reception in the openings of the inner and outer bands, respectively, and a twisted and bowed airfoil portion extending between the root and tip portions;

said twisted and bowed airfoil portion having a plurality of airfoil cross-sections different from one another at different radial locations therealong such that cross-sectional outlines of said different airfoil cross-sections are not coincident with one another in the radial direction;

each said blade having a generally airfoil-shaped footprint in the generally radial direction within which all surface areas of said airfoil portion projected in that direction onto a tangential plane normal to said generally radial direction lie either within or coincident with peripheral confines of said footprint; and said openings in said outer band having a generally airfoil-shaped cross-section at least as large as said footprint and generally complementary in shape relative to said footprint such that the blades are receivable through said outer openings with clearance, at least said tip portions of said blades having cross-sectional configurations at least as large as said footprint and substantially corresponding in cross-section to the cross-section of the openings though said outer band;

said blades and inner and outer bands being welded to one another.

2. An assembly according to claim 1 wherein the openings through said outer band are defined by walls extending generally parallel to one another between inner and outer surfaces of said outer band.

3. An assembly according to claim 2 wherein said tip portions of said blades have walls extending generally parallel to one another and generally complementary in shape to the walls of said openings through said outer band.

4. An assembly according to claim 2 wherein said root portions of said blades have walls extending generally parallel to one another, the openings through said inner band being defined by walls extending generally parallel to one another and generally complementary in shape to the walls of said root portions.

5. An assembly according to claim 4 wherein the walls of said openings in said inner and outer bands are generally parallel to one another.

6. An assembly according to claim 5 wherein said tip portions of said blades have walls extending generally parallel to one another and generally complementary in shape to the walls of said openings through said outer band.

7. An assembly according to claim 5 wherein said outer band is inclined in a radially outer direction from one edge to its opposite edge.

8. An assembly according to claim 1 wherein said blades are welded to said inner and outer bands.

9. An assembly according to claim 1 including welds formed on the outer diameter of the outer band for securing said outer band and said tip portions to one another such that the welds are located outside of the flowpath of the turbine.

10. An assembly according to claim 9 including welds formed on the inner diameter of the inner band for securing said root portions to one another such that the welds are located outside the flowpath of the turbine.

11. A method of manufacturing a turbine steam path assembly comprising the steps of:

providing arcuate inner and outer bands of different diameters;

providing a plurality of stator blades each having root and tip portions, an airfoil portion between said root and tip portions, and a footprint in a radial direction within which all surface areas of said airfoil portion projected in that direction onto a tangential plane normal to said generally radial direction lie either within or coincident with peripheral confines of said footprint;

forming a plurality of circumferentially spaced openings through said inner band between inner and outer surfaces thereof for receiving the root portions of said blades;

forming a plurality of circumferentially spaced openings through said outer band between inner and outer surfaces thereof of a cross-section larger than the openings through said inner band and at least as large as said footprint such that the blades are receivable through said outer openings;

forming said tip portions of said blades with cross-sectional configurations at least as large as said footprint and generally complementary in cross-sectional shape thereto;

arranging the inner and outer bands generally concentrically relative to one another;

inserting said blades in a radially inward direction through the openings in said outer band to locate said root portions in the openings in said inner band and said tip portions in the openings in said outer band;

providing stops at transitions between said root portions and said airfoil portions;

engaging said stops against said inner band to preclude further radially inward inserting movement; and welding said blades to said inner and outer bands.

12. A method according to claim 11 including forming wall portions defining each opening in said outer band generally parallel to one another and forming wall portions defining the tip portion of each blade generally parallel to one another.

13. A method according to claim 11 including forming wall portions defining each opening in said inner band generally parallel to one another and forming wall portions defining the root portion of each blade generally parallel to one another.

14. A flowpath assembly for the diaphragm of a turbine, comprising:

circumferentially extending inner and outer bands spaced radially from one another, each of said bands having a plurality of circumferentially spaced openings extending through the bands between inner and outer surfaces thereof;

a plurality of stator blades extending generally radially between said bands, each blade having root and tip portions for reception in the openings of the inner and outer bands, respectively, and a twisted and bowed airfoil portion extending between the root and tip portions;

each said blade having a generally airfoil-shaped footprint in the generally radial direction within which all surface areas of said airfoil portion projected in that direction onto a tangential plane normal to said generally radial direction lie either within or coincident with peripheral confines of said footprint;

said openings in said outer band having a generally airfoil-shaped cross-section at least as large as said footprint and generally complementary in shape relative to said footprint such that the blades are receivable through said outer openings with clearance, at least said tip portions of said blades having cross-sectional configurations at least as large as said footprint and substantially corresponding in cross-section to the cross-section of the openings though said outer band;

said blades and inner and outer bands being welded to one another;

the openings through said outer band being defined by walls extending generally parallel to one another between inner and outer surfaces of said outer band;

said root portions of said blades having walls extending generally parallel to one another, the openings through said inner band being defined by walls extending generally parallel to one another and generally complementary in shape to the walls of said root portions;

the walls of said openings in said inner and outer bands being generally parallel to one another; and said inner band being inclined in a radially outer direction from one edge to its opposite edge.

15. A flowpath assembly for the diaphragm of a turbine, comprising:

circumferentially extending inner and outer bands spaced radially from one another, each of said bands having a plurality of circumferentially spaced openings extending through the bands between inner and outer surfaces thereof;

a plurality of stator blades extending generally radially between said bands, each blade having root and tip portions for reception in the openings of the inner and outer bands, respectively, and a twisted and bowed airfoil portion extending between the root and tip portions;

each said blade having a generally airfoil-shaped footprint in the generally radial direction within which all surface areas of said airfoil portion projected in that direction onto a tangential plane normal to said generally radial direction lie either within or coincident with peripheral confines of said footprint;

said openings in said outer band having a generally airfoil-shaped cross-section at least as large as said footprint and generally complementary in shape relative to said footprint such that the blades are receivable through said outer openings with clearance, at least said tip portions of said blades having cross-sectional configurations at least as large as said footprint and substantially corresponding in cross-section to the cross-section of the openings though said outer band;

said blades and inner and outer bands being welded to one another; and a transition on each said blade at the juncture of said root portion and said airfoil portion forming a stop engaging said inner band and projecting laterally beyond confines of said inner band opening receiving said root portion.

16. An assembly according to claim 15 wherein the openings through said outer band are defined by walls extending generally parallel to one another between inner and outer surfaces of said outer band, said tip portions of said blades having walls extending generally parallel to one another and generally complementary in shape to the walls of said openings through said outer band, said root portions of said blades having walls extending generally parallel to one another, the openings through said inner band being defined by walls extending generally parallel to one another and generally complementary in shape to the walls of said root portions, the walls of said openings in said inner and outer bands being generally parallel to one another.

* * * * *